United States Patent [19]

Choi

[11] Patent Number: 4,838,587

[45] Date of Patent: Jun. 13, 1989

[54] MECHANISM FOR CONTROLLABLY DEADLOCKING A DOOR TO A DOOR FRAME, FOR PANIC RELEASE

[75] Inventor: Mansam Choi, Monrovia, Calif.

[73] Assignee: Adams Rite Manufacturing Company, City of Industry, Calif.

[21] Appl. No.: 188,841

[22] Filed: May 2, 1988

[51] Int. Cl.[4] ..... E05C 3/26

[52] U.S. Cl. ..... 292/216; 292/92; 292/DIG. 41

[58] Field of Search ..... 292/21, 45, 53, 92, 292/216, 280, DIG. 41

[56] References Cited

U.S. PATENT DOCUMENTS

| | | | |
|---|---|---|---|
| 1,203,116 | 10/1916 | Hurd | 292/21 |
| 1,544,960 | 7/1925 | Watts | 292/216 |
| 1,638,748 | 8/1927 | Santee | 292/48 |
| 2,458,751 | 1/1949 | Voight | 292/DIG. 41 X |
| 2,889,164 | 6/1959 | Clark | 292/216 X |
| 3,281,176 | 10/1966 | McKey | 292/DIG. 41 X |
| 4,083,590 | 4/1978 | Folger | 292/92 |
| 4,130,306 | 12/1978 | Brkic | 292/5 |
| 4,368,905 | 1/1983 | Hirchbein | 292/5 |

FOREIGN PATENT DOCUMENTS 2080391A 2/1982 United Kingdom .

*Primary Examiner*—Richard E. Moore

*Attorney, Agent, or Firm*—William W. Haefliger

[57] ABSTRACT

Apparatus deadlocking a door member to a door frame member, one of the members rigidly supporting a bolt to project freely in the direction of a first axis, for captivation by said mechanism, comprises:

(a) a body attachable to the other member, (b) a rotary latching structure carried by the body to pivot about a second axis generally parallel to the first axis, the latching structure including a latch forming a recess to relatively receive the bolt as the members relatively close and so that the bolt pivots the latch about the second axis into full latching position, therby to deadlock the two members, (c) a confinement wall on the body to face and confine the bolt in the recess in full latching position, (d) the latching assembly including a latch dog, (e) and a blocking and unblocking part extending in co-operation with the body and movable from a first location in which the latch dog is blocked to prevent pivoting of the latch to release the bolt, to a second location in which the dog is unblocked, to allow latch pivoting.

12 Claims, 3 Drawing Sheets

MECHANISM FOR CONTROLLABLY DEADLOCKING A DOOR TO A DOOR FRAME, FOR PANIC RELEASE

BACKGROUND OF THE INVENTION

This invention relates generally to mechanisms for deadlocking door members to door frame members in such manner as to accommodate sudden opening of the door members as by sudden pushing of associated panic bars.

Safety exit doors are widely used, and they commonly incorporate lock mechanisms which lock the doors to door frames, and which are releasable by operation of panic bars. See U.S. Pat. Nos. 1,638,748; 4,130,306; 4,083,590; and 4,368,905.

There is need for simple, compact, reliable mechanisms of this type which are readily installable upon such doors and door frame members to thereby provide safety exit door operation. U.S. patent application Ser. No. 067,132, filed June 29, 1987, and entitled "Lock Mechanism for a Safety Exit Door" provides a mechanism of this type, wherein a latching part in the form of a drum is rotatable about a horizontal axis to captivate a bolt member that projects downwardly from a door frame member. One disadvantage of such a latching part in the form of a drum is the requirement for precise relative vertical spacing of the drum relative to the bolt, i.e. the lack of sufficient vertical spacing tolerance as between the drum and bolt. Such tolerance is very desirable to accommodate installation of the apparatus to doors of different types and which may tend to move vertically somewhat as they swing between open and closed positions.

Another latching mechanism of this class is shown in U.K. Patent No. 20 80391 entitled, "Exit Door Locking Mechanisms Having Multiple Bolts." One problem with that mechanism is the lack of full captivation of the bolt, i.e. on all sides, by the latching part.

SUMMARY OF THE INVENTION

It is a major object of the present invention to provide an improved mechanism for deadlocking a door member to a door frame member, one of the members rigidly supporting a bolt to project freely in the direction of a first axis, for captivation. As will be seen, the mechanism basically comprises:

(a) a body attachable to the other member, (b) a rotary latching means carried by the body to pivot about a second axis generally parallel to the first axis, the latching means including a latch forming a recess to relatively receive the bolt as the members relatively close and so that the bolt pivots the latch about the second axis into full latching position, thereby to deadlock the two members, (c) a confinement wall on the body to face and confine the bolt in said recess in the full latching position, (d) the latching assembly including a latch dog, (e) and a blocking and unblocking part extending in co-operation with the body and movable from a first location in which the latch dog is blocked to prevent pivoting of the latch to release the bolt, to a second location in which the dog is unblocked, to allow said latch pivoting.

As will be seen, the latching means is typically rotatable in one direction about said second axis toward its full latching position, and in the opposite rotary direction about said second axis toward and into bolt releasing position, and including a spring associated with said body and rotary latching means for urging the rotary latching means toward bolt releasing position; also, the body typically includes a side wall attachable to one of said members, a top wall relative to which said confinement wall projects upwardly proximate one end of the top wall, there being an upright shaft mounted on the top wall and mounting said latching means above said top wall to rotate at a level proximate the top of said confinement wall.

In addition, the blocking and unblocking part may comprise an elongated rod adapted to be carried by said other member for endwise movement relative thereto; the body in typically attachable to upper extent of the door member so that the rod extends vertically beneath the body and is adapted to be displaced endwise vertically by a panic bar mounted on the door member. The panic bar is elongated and typically has a smooth decorative surface which is channel shaped in cross sections.

Also, the mechanism advantageously incorporates interengageable stops on the body and on said rotary latching means to limit rotation of the latch in one rotary direction about said second axis at said full latching position, and in the opposite rotary direction about said second axis at a bolt releasing position.

As will appear, the bolt typically extends downwardly from a door frame member for captivation in the latch recess as the door closes and the latch rotates sidewardly about its vertical axis of pivoting, the latch spaced well above the top of its support plate on the body so that ample tolerance space is provided for bolts of different lengths or projected extents, relative to the mechanism.

These and other objects and advantages of the invention, as well as the details of an illustrative embodiment, will be more fully understood from the following specification and drawings, in which:

DRAWING DESCRIPTION

DETAILED DESCRIPTION

Figure 1:
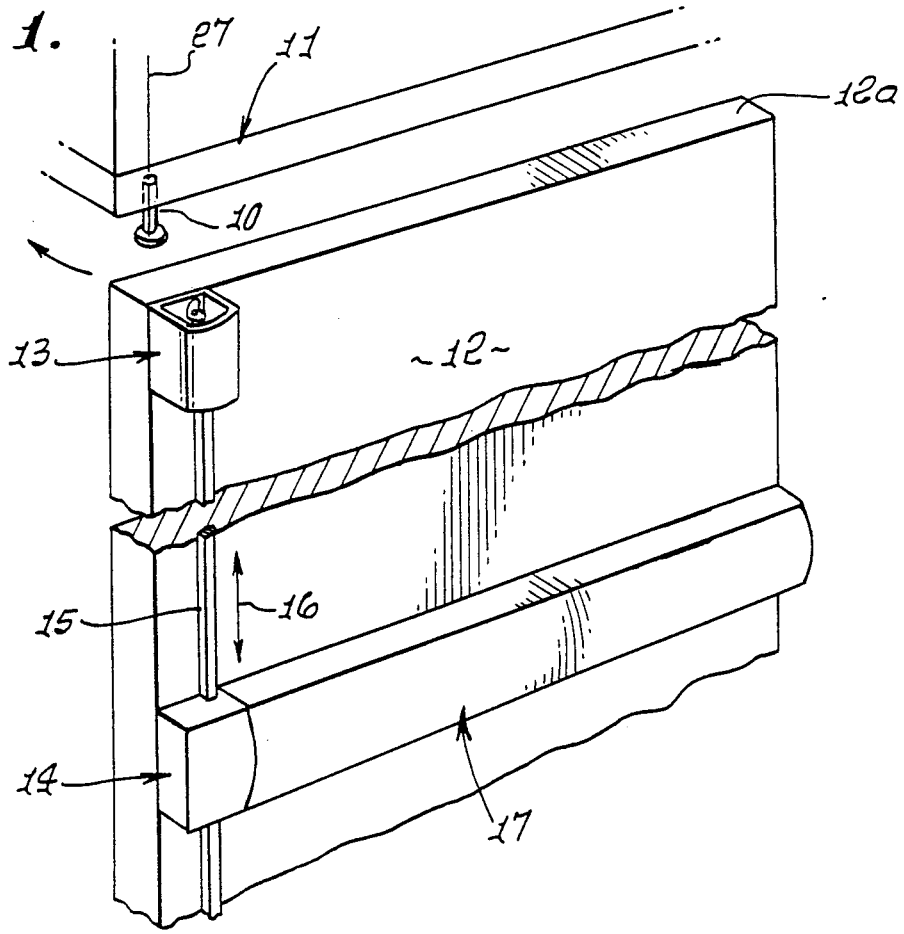
FIG. 1 is a perspective view showing the mechanism of the invention in relation to a panic bar and actuating means therebetween.
Figure 6:
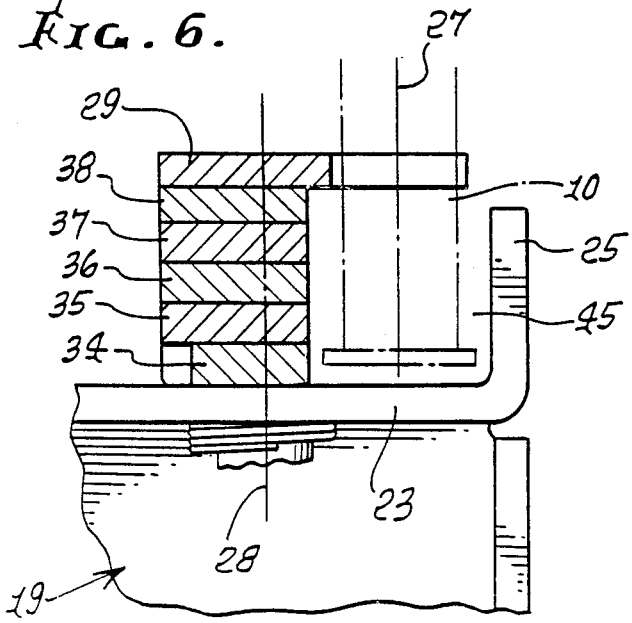
FIG. 6 is an elevation showing the bolt captivated position.

In FIG. 1, a locking bolt 10 is carried by, and projects rigidly and freely downwardly from a door frame upper transverse member 11, i.e. at the general level of the top 12*a* of a door member 12. Mechanisms 13, in block form, and incorporating the invention, is attached to the exterior uppermost side 12*b* of the door member. A panic bar 17 extends horizontally and is carried by the door at a lower "manual push" level; and block 14 also carried by the door represents actuator mechanism between the bar 17 and a vertically movable part 15, such as a rod acting as a latch blocking and unblocking part, as will appear. Arrows 16 indicate such rod up and down movement, as controlled by the panic bar. See for example the structures in U.K. Patent No. 20 80391.

Referring now to FIGS. 2–6, the mechanism 13 includes a hollow metallic, box-like body 19 having a side wall 20 attachable to the side of the door 12, as via fasteners 21 receivable through holes 22' in side wall 20. The body also includes upright flanged walls 21 and 22 integral with wall 20 and bent at 90° thereto. Walls 21 and 22 serve to support wall 23 if and when 23 bends downward under load. Further, the body includes top and bottom flanged walls 23 and 24 integral with wall 20, and bent at 90° thereto. See for example bends **23*a* and 24*a* A further upright wall 25 is integral with top wall 23, and bent upwardly at 25a**, for purposes as will appear.

A rotary latching means 26 is carried by the body, and typically by top wall 23, to pivot about an axis 28 which extends parallel to the axis 27 of bolt 10, both axes typically extending vertically. The latching means includes a latch 29 in the form of a plate which is generally C-shaped in horizontal plane, and forms a reces 30 having a C-shaped inner wall **30*a* defined by arms 31 and 32 of the C-shaped latch. The recess 30 is adapted to relatively receive the bolt 10 as the door member closes or pivots relatively toward the plane of the door frame member 11, whereby the bolt engages the inner edge 30*a'* of the arm 31 and forcibly pivots the latch plate about the second axis 28 as referred to, and into FIG. 5 position. In that position the bolt is confined by the C-shaped latch 29, and also by the upwardly projecting wall 25, referred to above. Thus, the bolt relatively moves from FIG. 4 position to FIG. 5 position, generally parallel to wall 25. In actuality, the wall 25 moves relative to the bolt, which is typically carried by the fixed position frame member 11**.

Pivoting of the latch is accommodated by a pivot shaft 33 carried by the top plate 23 to project upwardly, for spacing the latch 29 well above the top plate 23. Spacers 34–38 are mounted on shaft 33 and confined in stacked relation between 23 and 29, as shown. Other spacers may be employed, such as using one mechanism or spacer only. A pre-determined torsion spring 40 is located beneath plate 23 and wrapped about shaft 33 to urge the shaft, latch plate and spacers in one direction in FIGS. 4 and 5, and toward FIG. 5 position; thus as the bolt centers the recess 30, it rotates the latch in the opposite direction and against the force of the spring, further tensioning the latter. A head 41 on the lower end of the shaft holds the spring between 41 and 23. Torsion spring arm 42 engages the wall 23, and the opposite arm 43 of the spring is attached to head 41.

Of particular advantage is the fact that the space 45 between the latch plate 29 and the top wall 23 accommodate bolts of different lengths, i.e. that project downwardly to different extents into that space, as the bolt moves relatively into the recess 30 during door closing. Thus, the invention affords wide tolerance levels for interengaging parts, upon latching and unlatching.

A blocking and unblocking part, as in the form of rod 15 previously referred to, extends in cooperating relation with the body 19. As shown, the polygonal cross-section rod 15 extends upwardly into the hollow interior of the body, i.e. between walls 21 and 22, as via polygonal (square) cross-section guide openings 47 and 48 through the walls 23 and 24. The rod uppermost extent **15*a* in FIG. 5 extends into laterally blocking relation with a latch dog 50 integral with and projecting radially outwardly of spacer 35, which is rotatably attached to shaft 33 as via engagement therewith at flat area 51. When the rod extent 15*a* retracts downwardly below the level of the latch dog, as by panic pushing of the bar 17, the spring urges the latch toward FIG. 4 position, suddenly freeing the latch from the bolt, and allowing rapid opening of the door. Also, the force pushing bar 17 accelerates freeing of the latch from the bolt. Alternatively when the rod upper extent 15*a* engages the dog 50 at 50*a* in FIG. 5, the door is positively latched to the bolt 10**.

Figure 4:
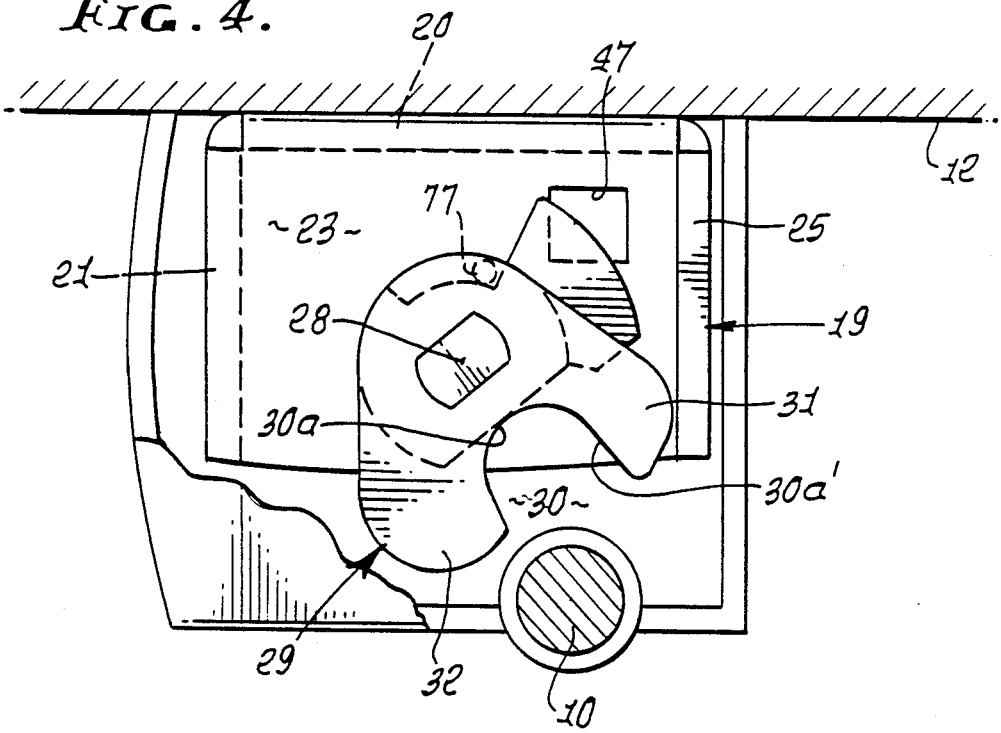
FIG. 4 is a top plan view on lines 4—4 of FIG. 2.
Figure 5:
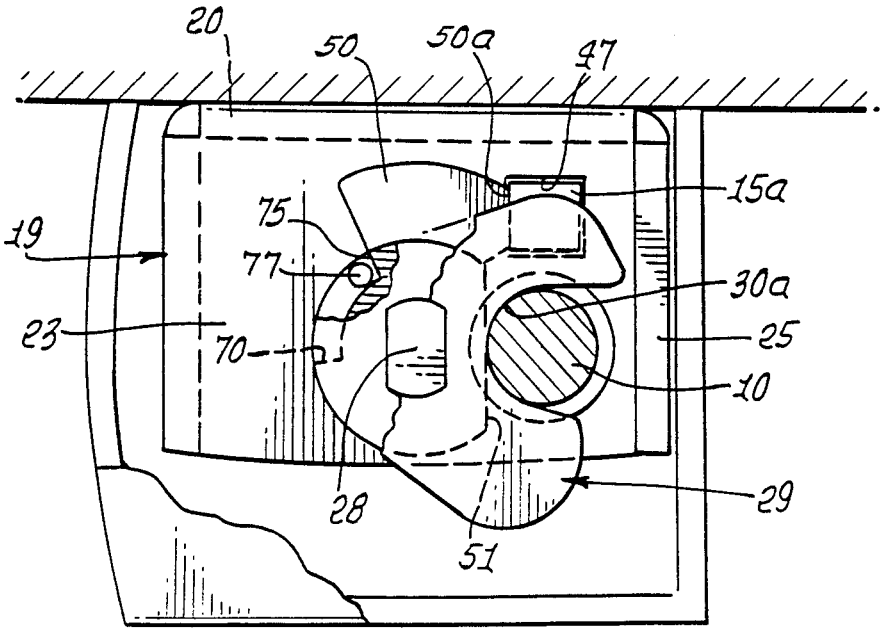
FIG. 5 is a view like FIG. 4 showing the bolt in captivated position.

The plate 34 defines two angularly spaced stops or stop shoulders 75 and 76 (see FIG. 5), alternately engageable with a stop pin 77 integral with top wall 23, thereby to limit rotation of the latch at FIG. 4 and FIG. 5 positions.

Figure 7:
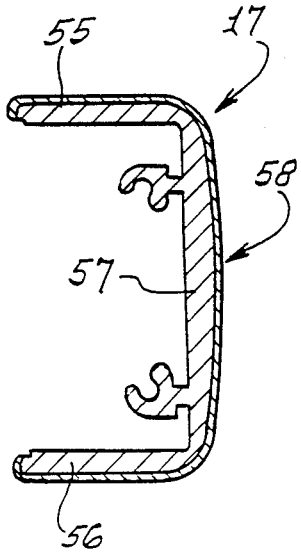
FIG. 7 is a section taken through a panic bar.
Figure 3:
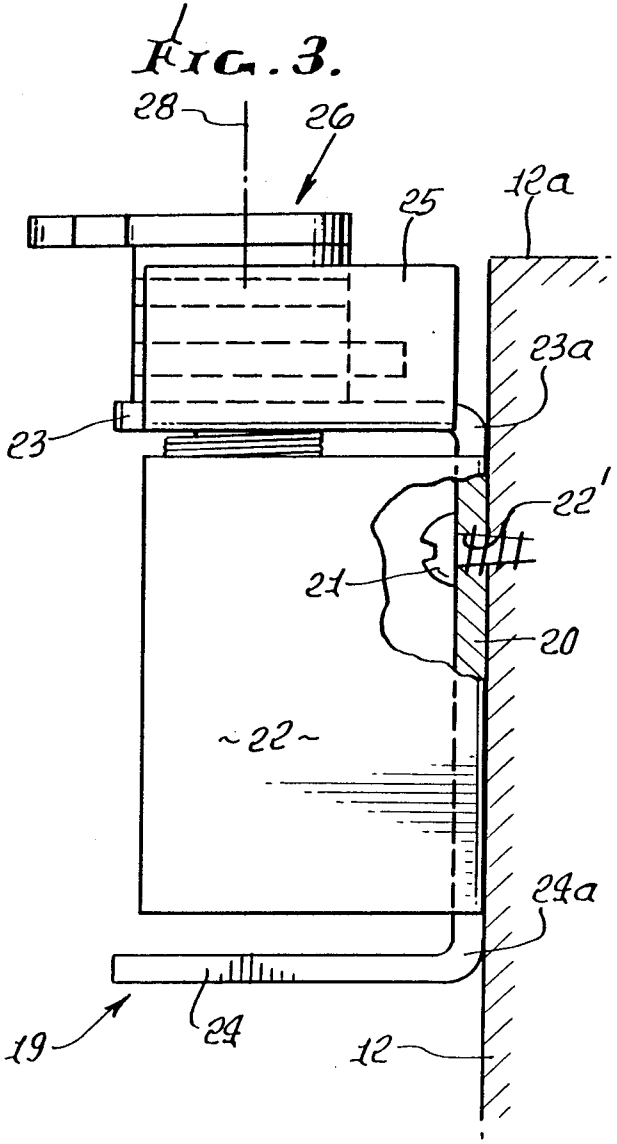
FIG. 3 is a side elevation taken on lines 3—3 of FIG. 2.
Figure 2:
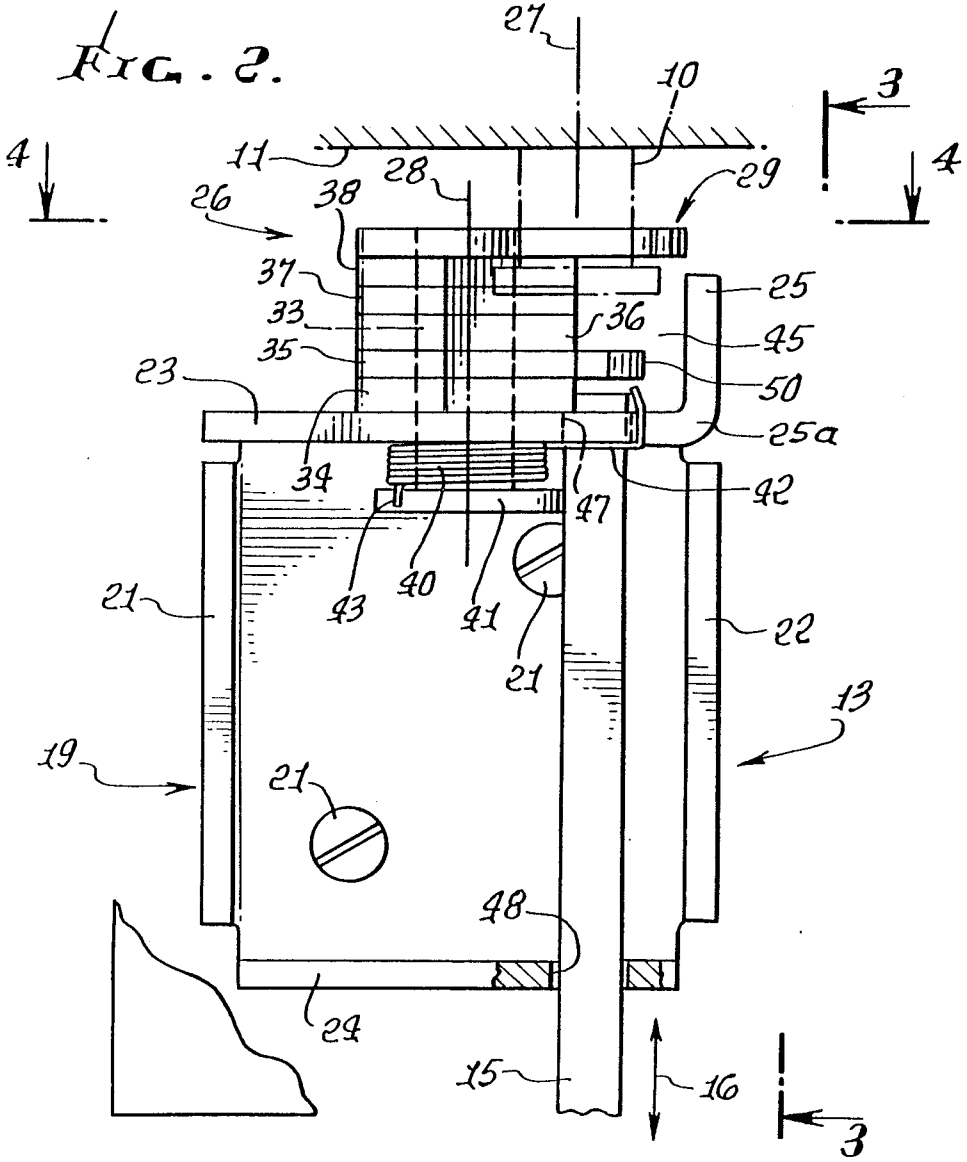
FIG. 2 is a front elevational view of the deadlocking mechanism.

Note in FIG. 7 that the panic bar 17 is elongated and has channel cross-section shape with structural flanges 55 and 56 integral with structural web 57. A thin, metallic U-shaped finishing sheet of metal 58 is attached to the outer sides of elements 55–57, as shown, and has a smooth or polished exterior surface, of chosen decorative polished bronze or stainless steel trim.

I claim:

1. Mechanism for deadlocking a door member to a door frame member, one of the members rigidly supporting a bolt to project freely in the direction of a first axis, for captivation by said mechanism, said mechanism comprising:

(a) a body attachable to the other member, (b) a rotary latching means carried by the body to pivot about a second axis generally parallel to the first axis, the latching means including a latch forming a recess to relatively receive the bolt as the members relatively close and so that the bolt pivots the latch about the second axis into full latching position, thereby to deadlock the two members, (c) a confinement wall on the body to face and confine the bolt in said recess in said full latching position, (d) the latching means including a latch dog, (e) a blocking and unblocking part extending in cooperation with the body and movable from a first location in which the latch dog is blocked to prevent pivoting of the latch to release the bolt, to a second location in which the dog is unblocked, to allow said latch pivoting, (f) the body including a side wall attachable to one of said members, a top wall relative to which said confinement wall projects upwardly proximate one end of the top wall, there being an upright shaft mounted on the top wall and mounting said latching means above said top wall to rotate at a level proximate the top of said confinement wall.

2. The mechanism of claim 1 wherein said blocking and unblocking part comprises an elongated rod adapted to be carried by said other member for endwise movement relative thereto.

3. The mechanism of claim 2 including said other member which comprises the door member, said body is attached to upper extent of the door member, and said rod extends generally vertically and is adapted to be displaced endwise vertically by a panic bar.

4. The mechanism of claim 3 including said panic bar carried by lower extent of the door member and operatively connected to the elongated rod for displacing that rod up and down.

5. The mechanism of claim 4 wherein said panic bar is elongated and has a smooth decorative surface which is channel shaped in cross section.

6. The mechanism of claim 1 including interengageable stops on the body and on said rotary latching means to limit rotation of the latch in one rotary direction about said second axis at said full latching position, and in the opposite rotary direction about said second axis at a bolt releasing position.

7. The mechanism of claim 1 wherein the latching means is rotatable in one direction about said second axis toward said full latching position, and in the opposite rotary direction about said second axis toward and into bolt releasing position, and including a spring associated with said body and rotary latching means for urging the rotary latching means toward said bolt releasing position.

8. The combination of claim 7 wherein said spring is a torsion spring extending about a shaft defined by said rotary latching means.

9. The combination of claim 1 wherein said rotary latching means includes a rotary shaft carrying said latch in the form of a latch plate forming said recess, the shaft carried by the body to extend upright in said second direction.

10. The combination of claim 1 including said bolt carried by the door frame member to project downwardly into said recess.

11. Mechanism for deadlocking a door member to a door frame member, one of the members rigidly supporting a bolt to project freely in the direction of a first axis, for captivation by said mechanism, said mechanism comprising:

(a) a body attachable to the other member, (b) a rotary latching means carried by the body to pivot about a second axis generally parallel to the first axis, the latching means including a latch forming a recess to relatively receive the bolt as the members relatively close and so that the bolt pivots the latch about the second axis into full latching position, thereby to deadlock the two members, (c) a confinement wall on the body to face and confine the bolt in said recess in said full latching position, (d) the latching means including a latch dog, (e) a blocking and unblocking part extending in cooperation with the body and movable from a first location in which the latch dog is blocked to prevent pivoting of the latch to release the bolt, to a second location in which the dog is unblocked, to allow said latch pivoting, (f) the latching means being rotatable in one direction about said second axis toward said full latching position, and in the opposite rotary direction about said second axis toward and into bolt releasing position, and including a spring associated with said body and rotary latching means for urging the rotary latching means toward said bolt releasing position, (g) the body including a side wall attachable to one of said members, a top wall relative to which said confinement wall projects upwardly proximate one end of the top wall, and there being an upright shaft mounted on the top wall and mounting said latching means above said top wall to rotate at a level proximate the top of said confinement wall.

12. Mechanism for deadlocking a door member to a door frame member, one of the members rigidly supporting a bolt to project freely in the direction of a first axis, for captivation by said mechanism, said mechanism comprising:

(a) a body attachable to the other member, (b) a rotary latching means carried by the body to pivot about a second axis generally parallel to the first axis, the latching means including a latch forming a recess to relatively receive the bolt as the members relatively close and so that the bolt pivots the latch about the second axis into full latching position, thereby to deadlock the two members, (c) a confinement wall on the body to face and confine the bolt in said recess in said full latching position, (d) the latching means including a latch dog, (e) a blocking and unblocking part extending in cooperation with the body and movable from a first location in which the latch dog is blocked to prevent pivoting of the latch to release the bolt, to a second location in which the dog is unblocked, to allow said latch pivoting, (f) a second wall on the body facing the confinement wall, said walls extending upright, a generally horizontal upper wall on the body and carrying the latching means, said second wall and confinement wall extending upwardly to support the upper wall under sufficient downward loading exerted on the upper wall.

* * * * *